United States Patent [19]

Totino et al.

[11] 4,325,315

[45] Apr. 20, 1982

[54] METHOD FOR SEWING A MONOGRAM PATTERN

[75] Inventors: Peter J. Totino, North Bergen; Alfonse N. Voza, Jersey City, both of N.J.

[73] Assignee: The Singer Company, Stamford, Conn.

[21] Appl. No.: 262,168

[22] Filed: May 11, 1981

[51] Int. Cl.[3] ..... D05B 3/02; D05B 97/00

[52] U.S. Cl. ..... 112/266.1; 112/121.11; 112/158 E

[58] Field of Search ..... 112/158 E, 158 R, 221, 112/121.11, 121.12, 266.1, 262.1, 264.1

[56] References Cited

U.S. PATENT DOCUMENTS

| | | | |
|---|---|---|---|
| D. 252,400 | 7/1979 | Rosenblad | 112/158 R UX |
| D. 253,355 | 11/1979 | Rosenblad | 112/158 R UX |
| D. 253,356 | 11/1979 | Rosenblad | 112/158 R UX |
| D. 253,357 | 11/1979 | Rosenblad | 112/158 R UX |
| 3,570,433 | 3/1971 | Weisz et al. | 112/266.1 |
| 4,123,981 | 11/1978 | Brown | 112/158 E |
| 4,135,462 | 1/1979 | Brown | 112/158 E |
| 4,188,900 | 2/1980 | Garron et al. | 112/264.1 |

*Primary Examiner*—H. Hampton Hunter

*Attorney, Agent, or Firm*—David L. Davis; Robert E. Smith; Edward L. Bell

[57] ABSTRACT

A method of operating a zig zag sewing machine to produce a visible pattern of zig zag stitches in a work fabric along a predetermined path to form a monogram within a defined field on the work fabric is initiated from a common starting location within the field. Initially, the needle bar is unlatched while longitudinal feeding takes place from that starting location so that no stitches are formed. This continues until a point of intersection is reached with the predetermined path. The needle bar is then latched and straight stitches, utilizing lateral needle feeding, are sewn along the predetermined path to a starting point for the monogram. Finally, zig zag stitches are formed along the path, covering the straight stitches and forming the monogram pattern.

4 Claims, 6 Drawing Figures

METHOD FOR SEWING A MONOGRAM PATTERN

DESCRIPTION

BACKGROUND OF THE INVENTION

This invention relates to a method of sewing a monogram and, more particularly, to an improved method for sewing a monogram wherein the monogram is within a defined field and sewing always begins from a predetermined point within that field independent of the monogram being sewn with the only visible stitches being zig zag stitches following a path to form the monogram.

When a plurality of monograms are to be sewn alongside one another, such as for example when three initials are sewn on a garment, it is essential that the monograms be appropriately aligned with respect to each other. A monogram pattern is generally sewn within a defined field of a work fabric. A problem typically arises in this regard because the sewing of different monograms begins at different places within the field and it is therefore difficult for an operator to properly position the field with respect to the sewing machine at the start of sewing so that the monograms are aligned after being sewn.

It is therefore an object of this invention to provide a method whereby a monogram is formed within a defined field in a manner that the operator may always place the field at a predetermined location and orientation with respect to the sewing machine independently of the monogram to be sewn.

SUMMARY OF THE INVENTION

The foregoing and additional objects are attained in accordance with the principles of this invention by providing a method of operating a zig zag sewing machine to produce a visible pattern of zig zag stitches in a work fabric along a predetermined path to form a monogram within a defined field on the work fabric, the method comprising the steps of locating the defined field on the work fabric at a predetermined location and orientation with respect to the sewing machine, unlatching the needle bar from the needle bar drive mechanism to prevent reciprocation of the needle bar, feeding the work fabric in a selected longitudinal direction substantially per pendicular to the direction of lateral jogging movement of the needle bar to a point of intersection with the predetermined path, latching the needle bar to the needle bar drive mechanism to allow reciprocation of the needle bar, sewing straight stitches along the predetermined path to a starting point for the monogram along the path, and sewing zig zag stitches along the path from the starting point to form the monogram.

In accordance with an aspect of this invention, the step of feeding only utilizes the sewing machine feed dog.

In accordance with a further aspect of this invention, the step of sewing straight stitches includes feeding the work fabric utilizing both the feed dog and the needle.

In accordance with another aspect of this invention, the step of sewing zig zag stitches includes feeding the work fabric utilizing both the feed dog and the needle.

BRIEF DESCRIPTION OF THE DRAWING

The foregoing will be more readily apparent upon reading the following description in conjunction with the drawing wherein.

DETAILED DESCRIPTION

Figure 1:
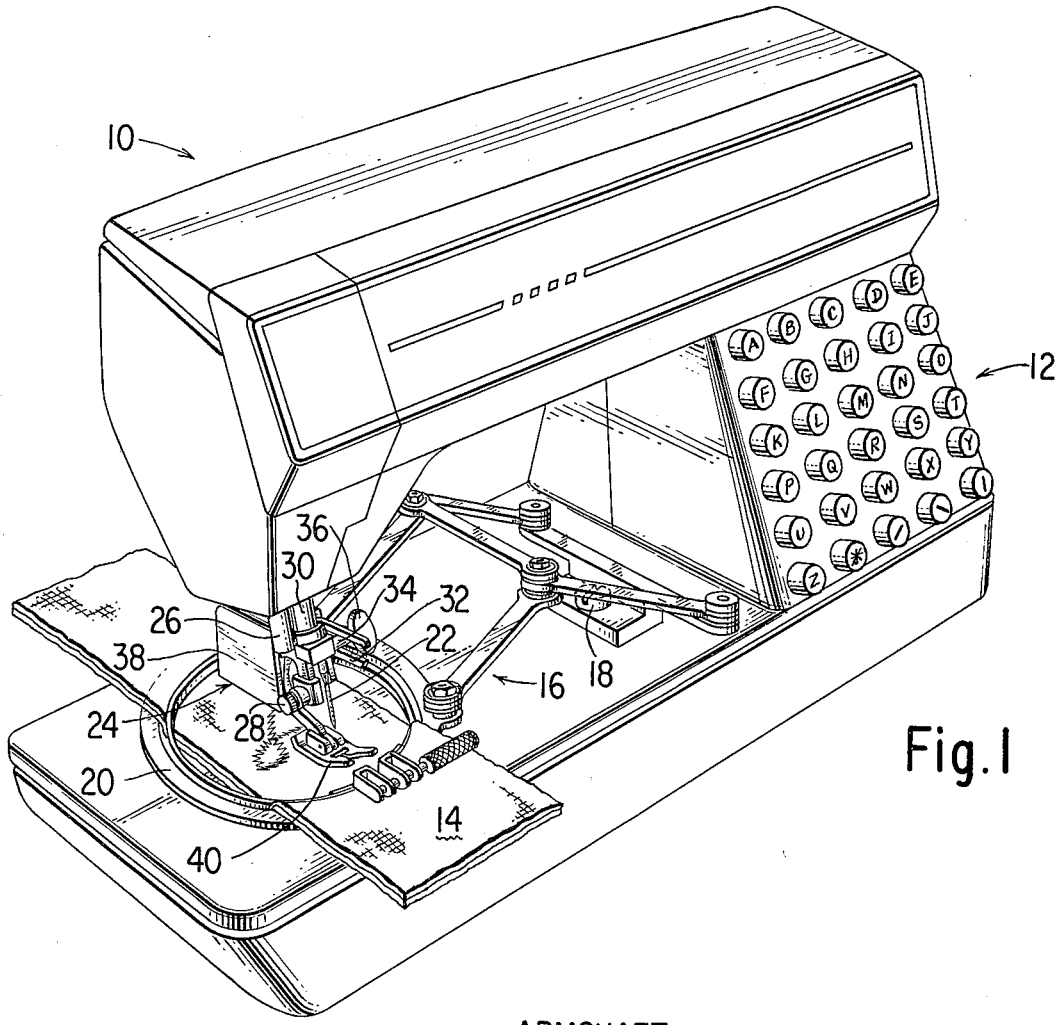
FIG. 1 is a perspective view of a sewing machine in which the method according to this invention may be practiced.

Referring to the drawings, FIG. 1 illustrates a sewing machine indicated generally at 10 adapted for the sewing of monogram patterns. Accordingly, the sewing machine 10 is provided with an array 12 of monogram pattern selection switches, in addition to other control elements which, for the sake of simplicity, are not shown in the drawing. For the sewing of monogram patterns on a work fabric 14, there is provided a parallel linkage 16 clamped at one end to the sewing machine bed by means of a screw 18. At the other end of the parallel linkage 16 there is provided an embroidery hoop 20 for holding the work fabric 14. The parallel linkage 16 and the embroidery hoop 20 are for the purpose of preventing the work fabric 14 from turning during the sewing of a monogram pattern.

When sewing a monogram pattern, as will be described in more detail hereinafter, lateral feeding of the work fabric 14 is accomplished by effecting lateral motion of the sewing needle 22 while it is penetrating the work fabric 14. To accommodate this lateral motion of the work fabric 14, a special presser foot mechanism 24 is preferably utilized. The presser foot mechanism 24 is coupled both to the presser bar 26 in a conventional manner through use of a thumb screw 28 and to the needle bar 30 by means of a bifurcated tab 32 which fits over the shaft 34 of the thumb screw 36 of the needle clamp. The presser foot mechanism 24 is arranged, by means of links within a cover 38 to alternately apply and relieve pressure from the work fabric 14. When the needle 22 penetrates the work fabric 14, the presser foot mechanism 24 raises the presser foot 40 and when the needle 22 leaves the work fabric 14 the presser foot mechanism 24 lowers the presser foot 40 into contact with the work fabric 14. Accordingly, when the needle 22 is penetrating the work fabric 14 any lateral movement of the needle 22 will effect a corresponding lateral movement of the work fabric 14.

Figure 2:
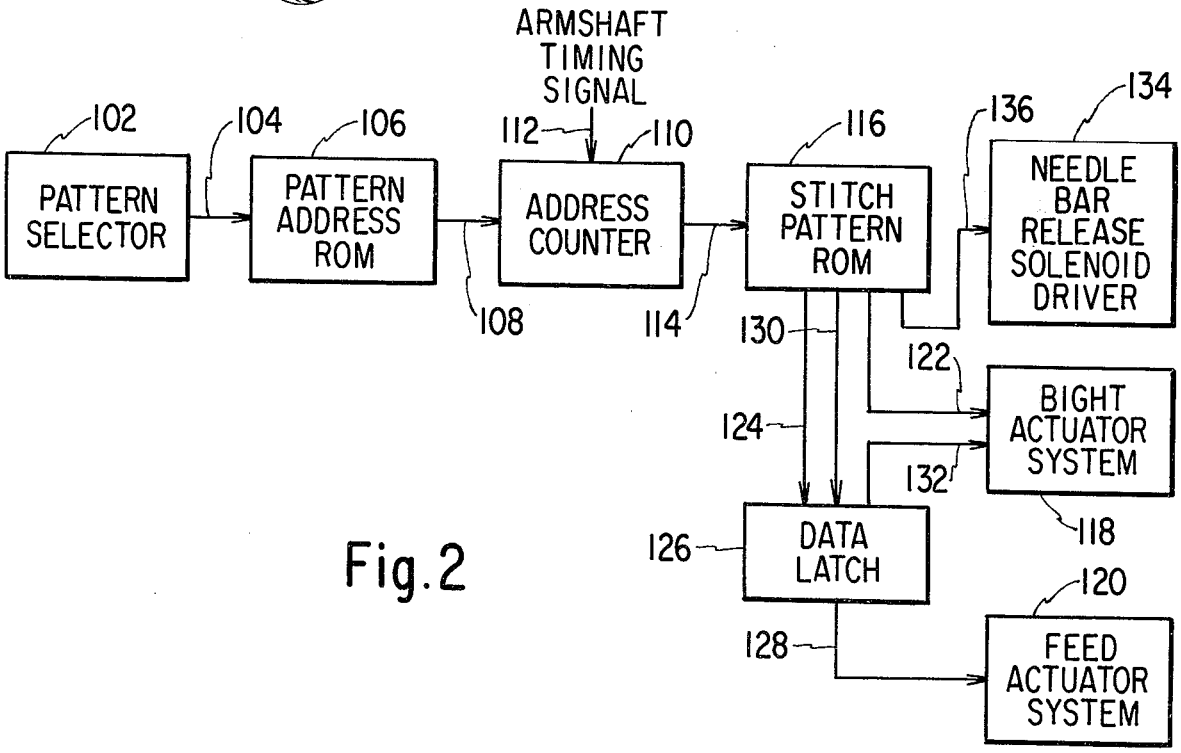
FIG. 2 forms a block schematic diagram of illustrative circuitry which may be utilized to control the sewing machine of FIG. 1 to practice the method of this invention.

Referring to FIG. 2, there is shown a general schematic block diagram of circuitry for controlling the sewing machine 10 and by which the needle bar 30 and the sewing needle 22 carried thereby may be shifted to a selected lateral position and the feed dog (not shown) may be moved in a selected direction for feeding of the work fabric 14 in a longitudinal direction. The circuitry shown in FIG. 2 is also operative for effecting lateral movement of the work fabric 14, generally referred to as needle feeding. For a detailed description of the operation of the circuitry of FIG. 2, the reader is referred to U.S. Pat. No. 4,135,462 which issued to Jack Brown on Jan. 23, 1979, the contents of which is hereby incorporated by reference. However, the operation of the circuitry shown in FIG. 2 will be briefly described herein. When the operator selects a pattern by depressing one of the switches in the array 12, the pattern selector 102 provides an appropriate pattern selector code word on the leads 104 to the pattern address ROM 106. The pattern address ROM 106 provides over the leads 108 to the address counter 110 a code word representing the selected pattern. This code word on the leads 108 determines the starting point of the address counter 110 which has a count input line 112 upon which are provided pulses from the armshaft timing pulse generator (not shown). The address counter 110 has output leads 114 which are connected to the address inputs of a stitch pattern ROM 116.

The bight actuator system 118 and the feed actuator system 120 are similar in construction and are adapted to convert a digital code word from the stitch pattern ROM 116 into a mechanical position which locates the sewing machine needle in a conventional stitch forming instrumentality and provides a specific work feed for each needle penetration. As disclosed in the above referenced U.S. Pat. No. 4,135,462, the stitch pattern ROM 116 includes stitch pattern information in the form of digital code words which is outputted over the leads 122 when the sewing needle 22 is out of the work fabric 14 to the bight actuator system 118 and at the same time a digital code word is provided over the leads 124 to the data latch 126 where it is held until the needle 22 enters the work fabric 14, at which time it is provided over the leads 128 to the feed actuator system 120. Additionally, the stitch pattern ROM 116 includes supplemental stitch pattern information for controlling needle feed of the work fabric 14. This supplemental stitch pattern information is outputted from the stitch pattern ROM 116 over the leads 130 to another section of the data latch 126 and is applied to the bight actuator system 118 via the leads 132 when the needle 22 penetrates the work fabric 14.

The sewing machine 10 also includes a needle bar release device which includes a solenoid. Such a device is illustratively of the type described in U.S. Pat. No. 3,872,802, which issued to Adams et al on Mar. 25, 1975, the disclosure of which is hereby incorporated by reference. This needle bar release device has a latch release member that is movable by a solenoid into engagement with a coupling member to unlatch the coupling member from the needle bar drive mechanism. Accordingly, when the needle bar is unlatched from the needle bar drive mechanism, the needle bar is prevented from reciprocating and when the needle bar is latched to the needle bar drive mechanism, this effects reciprocation of the needle bar in synchronism with the needle bar drive mechanism. Such a device is also commonly termed a skip stitch mechanism. The needle bar release solenoid is driven by a needle bar release solenoid driver 134. The stitch pattern ROM 116 also includes information as to when the solenoid is to be activated to unlatch the needle bar from the needle bar drive mechanism. This information is outputted from the stitch pattern ROM 116 to the needle bar release solenoid driver 134 over the lead 136.

Figure 3:
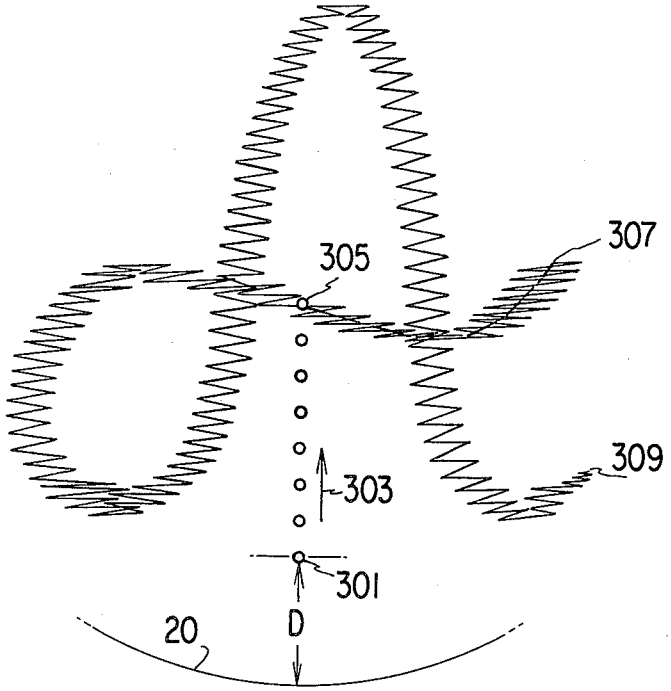
FIGS. 3–6 are representations of illustrative monogram patterns sewn in accordance with the method of this invention.

Referring now to FIGS. 3–6, shown therein are illustrative monogram patterns as they would be sewn by the method of this invention. Looking at FIG. 3, shown therein is an illustrative monogram pattern for the letter "A". This letter, as all other monogram patterns, is sewn within a defined field which for purposes of illustration can be considered to be the circle defined by the embroidery hoop 20. Initially, the defined field, i.e. the embroidery hoop 20, is placed in a predetermined location and orientation with respect to the sewing machine. In particular, the point 301 which is along a longitudinal diameter of the hoop 20 and spaced a fixed distance D from the hoop 20 is placed directly beneath the needle 22. The operator then selects one of the monogram patterns by actuating one of the switches in the array 12 (FIG. 1) and starts sewing. The first set of instructions from the stitch pattern ROM 116 (FIG. 2) causes the needle bar release solenoid to unlatch the needle bar from the needle bar drive mechanism to prevent reciprocation of the needle bar. Next, in accordance with information retrieved from the stitch pattern ROM 116, the work fabric is fed in a selected longitudinal direction substantially perpendicular to the direction of lateral jogging movement of the needle bar. This feeding without needle penetrations and stitch formation is indicated on FIG. 3 by the small open circles and proceeds in the direction indicated by the arrow 303. The monogram pattern will be formed by producing a visible pattern of zig zag stitches along a predetermined path. The feeding without stitch formation proceeds up to a point of intersection with that predetermined path, that point of intersection being referenced as 305. Next, the needle bar is latched to the needle bar drive mechanism to allow reciprocation of the needle bar. Straight stitches are sewn along the monogram pattern path to a starting point 307 for the monogram. These straight stitches are sewn utilizing both the sewing machine feed dog and the lateral needle feeding capability of the sewing machine. Zig zag stitches are then sewn along the path from the starting point 307 to form the monogram, the zig zag stitches terminating at the point 309. These zig zag stitches are sewn utilizing both the sewing machine feed dog and the lateral needle feeding capability of the sewing machine. Alternatively, straight stitches could be sewn from the point 305 along the path to the point 309 and then zig zag stitches could be sewn from the point 309 along the path to the point 307. Thus, since stitching only occurs along the monogram pattern path and since the straight stitching to arrive at a starting point is covered by zig zag stitches forming the monogram, the only visible monogram stitches are the zig zag stitches and thread trimming is necessary only at the start and finish of stitch formation, i.e. at the points 305 and 309.

Figure 4:
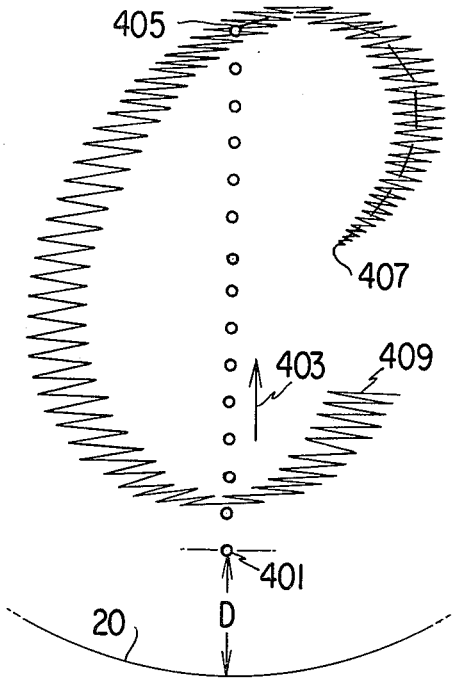

FIG. 4 illustrates the formation of a monogram pattern for the letter "C". The field defined by the embroidery hoop 20 is positioned on the sewing machine so that the needle 22 is directly above the point 401. This point 401 corresponds to the point 301 (FIG. 3) in that it is along a longitudinal diameter of the hoop 20 a fixed distance D from the hoop 20. Feeding of the work fabric with the needle bar unlatched proceeds from the point 401 in a direction indicated by the arrow 403 to the point 405 which is an intersection with the path forming the monogram. Straight stitching then proceeds along the path to the point 407 and zig zag stitching, which covers the straight stitching, is performed along the path, terminating at the point 409 to form the monogram pattern.

Figure 5:
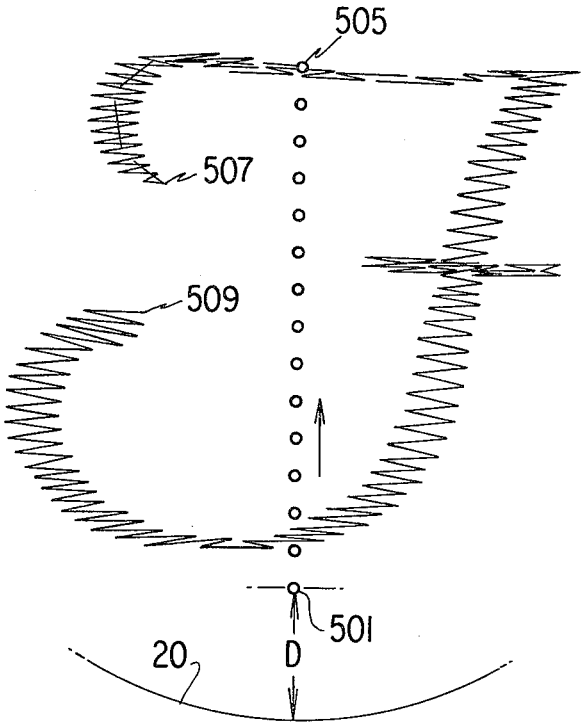

FIG. 5 shows the formation of a monogram pattern for the letter "F" wherein the field defined by the hoop 20 is initially located with the needle 22 above the point 501, feeding with the needle bar unlatched proceeding to the point 505, straight stitching proceeding to the point 507 along the path forming the monogram, and zig zag stitching proceeding along the path to the point 509 to form the monogram pattern.

Figure 6:
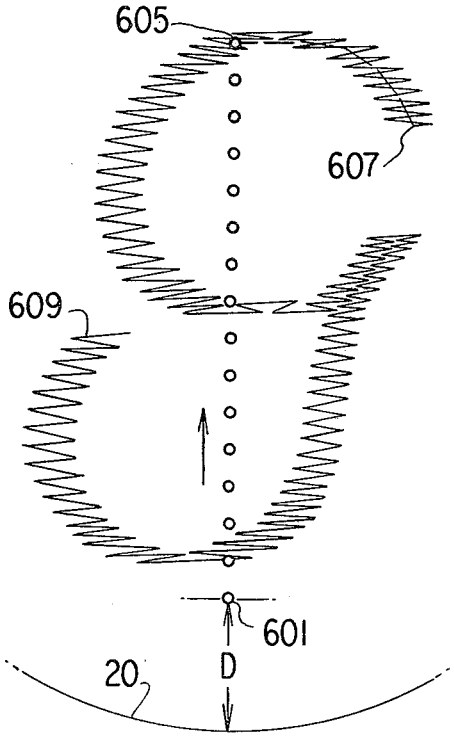

Similarly, FIG. 6 shows the formation of a monogram pattern for the letter "G" wherein the field defined by the hoop 20 is positioned so that the needle 22 is above the point 601, the needle bar is unlatched and feeding takes place up to the point 605 along the predetermined path for forming the pattern, straight stitching takes place along the path to the point 607, and zig zag stitching takes place along the path to the point 609 to form the monogram pattern.

Accordingly, there has been disclosed an improved method for sewing a monogram pattern. It is understood that the above-described method is merely illustrative of the application of the principles of this invention, and it is only intended that this invention be limited by the scope of the appended claims.

We claim:

1. A method of operating a zig zag sewing machine to produce a visible pattern of zig zag stitches in a work fabric along a predetermined path to form a monogram within a defined field on the work fabric, comprising the steps of:

locating the defined field on the work fabric at a predetermined location and orientation with respect to the sewing machine;

unlatching the needle bar from the needle bar drive mechanism to prevent reciprocation of the needle bar;

feeding the work fabric in a selected longitudinal direction substantially perpendicular to the direction of lateral jogging movement of the needle bar to a point of intersection with said predetermined path;

latching the needle bar to the needle bar drive mechanism to allow reciprocation of the needle bar;

sewing a straight stitch along said predetermined path to a starting point for said monogram along said path; and sewing zig zag stitches along said path from said starting point to form said monogram.

2. The method of claim 1 wherein the step of feeding only utilizes the sewing machine feed dog.

3. The method of claim 2 wherein the step of sewing straight stitches includes feeding the work fabric utilizing both the feed dog and the needle.

4. The method of claim 3 wherein the step of sewing zig zag stitches includes feeding the work fabric utilizing both the feed dog and the needle.

* * * * *